US007014088B2

(12) United States Patent
Brown

(10) Patent No.: US 7,014,088 B2
(45) Date of Patent: Mar. 21, 2006

(54) STAPLING DEVICE

(76) Inventor: Christopher T. Brown, 1964 Hollister Hill Rd., Delhi, NY (US) 13753

( * ) Notice: Subject to any disclaimer, the term of this patent is extended or adjusted under 35 U.S.C. 154(b) by 0 days.

(21) Appl. No.: 10/933,891

(22) Filed: Sep. 4, 2004

(65) Prior Publication Data

US 2005/0218187 A1 Oct. 6, 2005

Related U.S. Application Data

(60) Provisional application No. 60/559,476, filed on Apr. 5, 2004.

(51) Int. Cl.
*B25C 1/04* (2006.01)

(52) U.S. Cl. ..... 227/109; 227/134; 227/147

(58) Field of Classification Search ..... 227/109, 227/134, 147, 156, 107
See application file for complete search history.

(56) References Cited

U.S. PATENT DOCUMENTS

| | | | | |
|---|---|---|---|---|
| 1,568,308 A | * | 1/1926 | Albee | 227/147 |
| 2,330,575 A | | 9/1943 | Grauding | |
| 3,044,072 A | * | 7/1962 | Haynes | 227/118 |
| 3,789,495 A | * | 2/1974 | Stumpf | 29/429 |
| 3,883,064 A | * | 5/1975 | Hilgers | 227/120 |
| 4,204,625 A | * | 5/1980 | Glenn | 227/76 |
| 4,415,111 A | | 11/1983 | McHarrie et al. | |
| 4,438,169 A | | 3/1984 | Daniels et al. | |
| 4,834,342 A | * | 5/1989 | Padgett | 227/147 |
| 4,903,882 A | | 2/1990 | Long | |
| 5,052,607 A | * | 10/1991 | Dutton | 227/107 |
| 5,163,597 A | | 11/1992 | Napoli, Jr. et al. | |
| 5,328,077 A | * | 7/1994 | Lou | 227/175.1 |
| 5,370,293 A | | 12/1994 | Bevins | |
| 5,425,490 A | | 6/1995 | Goble et al. | |
| 5,524,808 A | * | 6/1996 | Vogrig | 227/147 |
| 6,189,418 B1 | * | 2/2001 | Sloan et al. | 81/57.36 |
| 6,364,880 B1 | * | 4/2002 | Michelson | 606/61 |
| 6,379,364 B1 | * | 4/2002 | Brace et al. | 606/96 |

* cited by examiner

*Primary Examiner*—Scott A. Smith

(57) ABSTRACT

The present invention provides for the safe and effective installation of staples. The device has a hollow body at its upper end, a cap plate with an opening attached to the upper end of the body, and a driver shaft mounted to slide within the cap plate. A block is secured within the body at the lower end of the body remote from the cap plate. The block has two channels and a striker slides through the channels. An indentation is located in the lower end of the block to hold the arch of a staple. A driver plate slides within the body and is secured to the driver shaft on one side and to both strikers on the opposite side. A driver spring and a pair of striker springs surround the driver shaft and strikers, respectively. The channels guide the strikers while the indentation positions the staple. This causes the strikers to strike the brads of the staple simultaneously, without damaging either the staple or the brads and, most importantly, the wiring or cabling the staple secures.

10 Claims, 2 Drawing Sheets

STAPLING DEVICE

CROSS REFERENCE TO RELATED APPLICATION

This patent application claims the benefit of an earlier filing date under 35 USC 119(e) of a provisional patent application, filed in the United States Patent and Trademark Office on Apr. 5, 2004, and entitled DEVICE FOR NAILING ELECTRICAL STAPLES, and being Provisional Patent Application No. 60/559,476.

BACKGROUND OF THE INVENTION

1. Field of the Invention

This invention relates to a stapling device and, more specifically, to a stapling device for holding insulated wiring or cabling in place without damaging the wire or cable or the nails.

2. Description of the Related Art

The staple that relates to this invention has a plastic arch that is held in place by two brads. This type of staple is safer to use to hold electrical wire or cabling than is an all-metal staple. The possibility of short-circuiting the wires being held is reduced because the arch of the staple is insulated.

Staples used to hold wiring must be set tightly enough in the base and around the wires to hold the wires in place. However, they cannot be set so tightly that they crush the insulation surrounding the wires or expose the wires themselves. If the staples are set incorrectly and do crush the insulation or expose the wire, the likelihood of an electrical fire is greatly increased. Therefore, the depth to which the staple is nailed must be controlled by some means to keep the staple from binding the wires so tightly that the staple itself creates a short-circuit and the increased possibility of fire.

Staples with an insulated arch require that two metal brads which are made of metal are forced into supporting structure. This is often done by using a hammer which may force the staple into the insulation on the wire or strike the cabling or wiring, thereby crushing the insulation causing a short-circuit and possible electrical fire. A hammer may also bend the brads. In the past, this problem has been considered by others.

Grauding, U.S. Pat. No. 2,330,575, teaches a single sliding shaft tool for driving a staple or other fastening element into a base. The shaft is spring-loaded and the device shows the basic concept of using a spring-loaded device to drive a staple only a restricted distance. Grauding provides for setting a wide variety of fasteners, but does not show a device for setting two brads simultaneously.

McHarrie, et al. U.S. Pat. No. 4,415,111, teaches a staple-driving device which has a locator and two pins to place the staple. The McHarrie device is for orthopedic use. McHarrie, like Grauding, teaches a single-shaft punch. The device taught by McHarrie et. al. does not provide for setting two pins or brads simultaneously.

Pratt et al., U.S. Pat. No. 4,438,769, involves another medical stapling device. Pratt, et. al. teaches a stapling device that does not limit the depth of penetration of the staple being inserted. The Pratt et al. device may also be used to pull staples by reversing the hammer sleeve action. Long, U.S. Pat. No. 4,903,882, teaches a stapling device for electrical work. The Long device has no moving parts; the invention provides a bar that is offset to reach remote locations and has a cavity to hold the staples and straddle the cable or wiring. When the staple is in place, the device strikes the surface to which the cable or wiring is being secured.

Napoli, Jr. et al. U.S. Pat. No. 5,163,597, teaches a sliding hammer which slides on the handle of a device similar to the Long device to provide a hammer action. The Napoli Jr. device provides for limiting the depth to which brads are inserted into a substrate, but does not provide for two brads being hammered into a substrate simultaneously. Napoli Jr. also provides a rotating hook that the user can insert under the installed staple to remove the staple.

Bevins, U.S. Pat. No. 5,370,293, teaches a device for electrical cable stapling that provides for two brads being simultaneously affixed to a substrate in a manner similar to that used to affix a staple into a page of paper. However, the Bevins device does not use an actuating shaft or driver shaft. Rather, the electrical staple is affixed to a substrate using a device in which an L-shaped mechanism is used to hold a staple, and the mechanism itself is hit with a hammer to nail the staple to a substrate. Either end of the Bevins device can be used, depending on the space available. Staple holders of varying sizes can be placed on either end of the unit.

Goble et al., U.S. Pat. No. 5,425,490, teaches a device for reattaching a ligament or the like onto the surface of a bone. The staple used in the Goble device is a surgical staple rather than an electrical staple and the manner of connecting the staple to the Goble device differs from that of electrical stapling devices.

Objects

Therefore it is an object of the present invention to provide a staple driver that does not crush the insulated electrical wire or bend the staple brads.

It is also an object of the invention to provide a staple driver that holds the staple in place.

It is still another object of the invention to provide a stapling device that is easily handled.

It is a further object of the invention to provide a device for stapling that is durable, dependable and comparatively inexpensive.

SUMMARY OF THE INVENTION

The invention provides a stapling device for nailing insulated electrical staples to a substrate wherein a driver shaft is struck which simultaneously nails two brads to the substrate. The device has an upper end and a lower end. The upper end is hollow. The lower end is uncovered. The upper end is covered with a cap plate through a driver plate through which a driver shaft is inserted to slide. The lower end has a block within it. The block has two channels through it. A driver plate that slides within the upper section of the body is mounted on the driver shaft at the end remote from the cap plate. A spring surrounds the driver shaft between the cap plate and the driver plate that forces the return of the driver shaft after the driver shaft is depressed and released. Two strikers are connected to the driver plate and extend away from the driver shaft and within the channels in the block striking brads of a staple and inserting the brads into the substrate when the driver shaft is depressed. A striker spring surrounds each striker. The striker spring also acts to return the strikers to their original position when the strikers are depressed by the driver plate and driver shaft.

DESCRIPTION OF THE NUMERALS

| DESCRIPTION | NUMERAL |
|---|---|
| BODY | 11 |
| UPPER END | 13 |
| LOWER END | 15 |
| FRONT AND BACK | 17 |
| TWO SIDES | 19 |
| CAP PLATE | 21 |
| DRIVER SHAFT | 23 |
| INSIDE END | 25 |
| OUTSIDE END | 27 |
| OPENING | 28 |
| HEAD | 29 |
| DRIVER PLATE | 31 |
| DRIVER SPRING | 33 |
| STRIKERS | 35 |
| BLOCK | 37 |
| ARCH | 38 |
| BLOCK PIN | 39 |
| CHANNELS | 41 |
| STRIKER SPRINGS | 43 |
| INDENTATION | 44 |
| STAPLE | 45 |
| BRADS | 47 |

DETAILED DESCRIPTION OF THE PREFERRED EMBODIMENT

Figure 1:
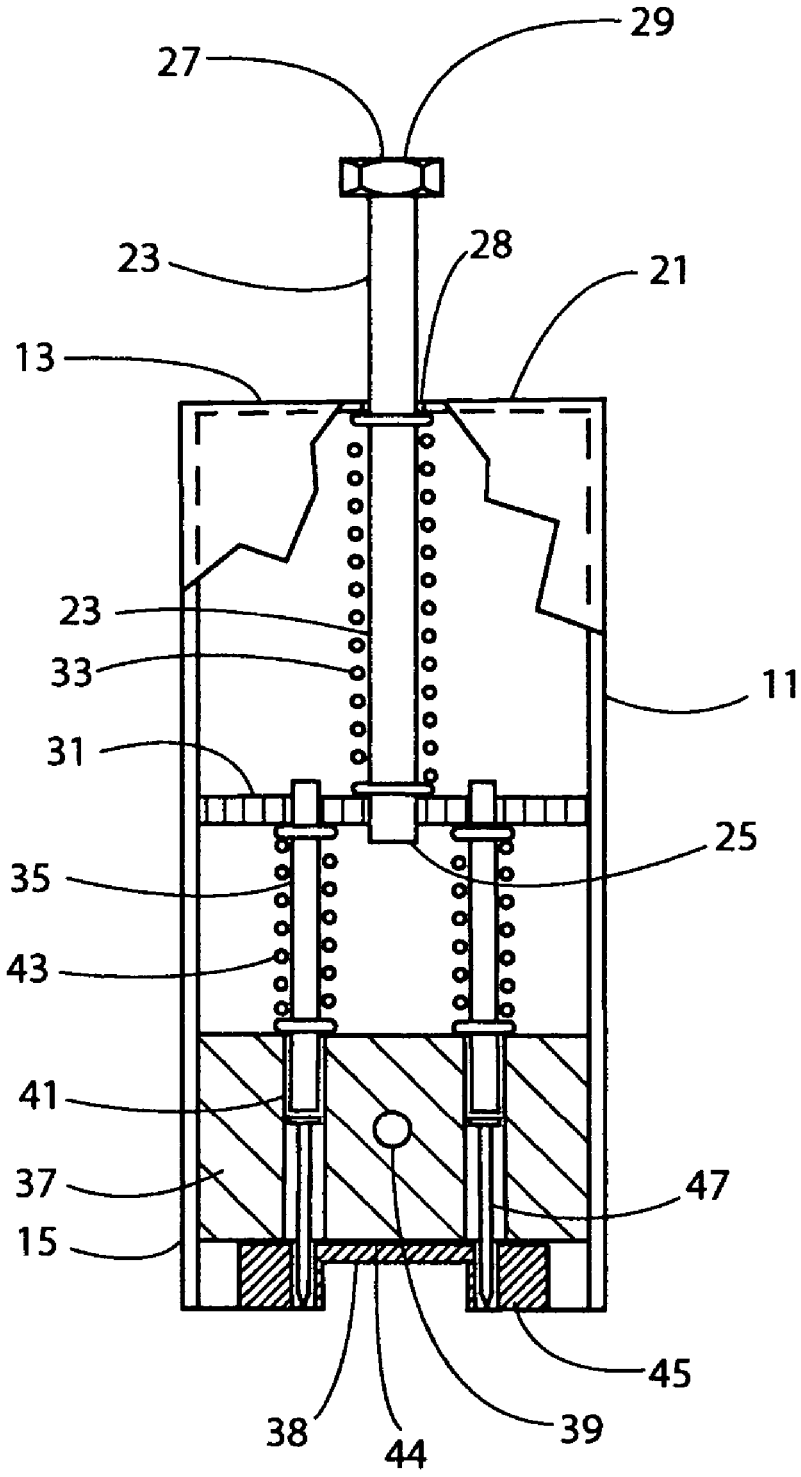
FIG. 1 is a front or back elevation of the Stapling Device substantially broken away showing the interior of the Stapling Device.

Referring now to FIG. 1, a front elevation of the Stapling Device is shown substantially broken away. The device has a body 11 that has a rectangular cross-section both vertically and horizontally, though the body 11 may be of other shapes. The body 11 has two ends, namely an upper end 13 and a lower end 15. It also has a front, and back 17, which are interchangeable. The device also has two sides 19 which are interchangeable. A cap plate 21 is located at the upper end 13 of the body 11. The cap plate 21 encloses the upper end 13 of the body 11. A driver shaft 23, which has two ends, namely an inside end 25 and an outside end 27, is mounted to slide through an opening 28 in the cap plate 21. A head 29 is secured to the driver shaft 23 at the outside end 27. In other embodiments, the head 29 can be omitted. A driver plate 31 is located within the body 11. The driver shaft 23 is affixed to the driver plate 31 and projects upwardly from the driver plate 31 through the cap plate 21. The driver shaft 23 is surrounded by a driver spring 33 which is located between the cap plate 21 and the driver plate 31.

Also attached to the driver plate 31 are two strikers 35 that project downwardly from the driver plate 31 generally at right angles to driver plate 31 so that the two strikers 35 are generally parallel to one another. The strikers 35 are substantially equal in length. A block 37 is secured inside the body 11 at the lower end 15 by a block pin 39. The block 37 has two channels 41 through it. The strikers 35 are mounted to slide in the channels 41 of the block 37. The strikers 35 move toward the lower end 15 when the driver shaft 23 is depressed. Each striker 35 is surrounded by a striker spring 43 located between the driver plate 31 and the block 37. At the lower end 15 of the block 37 there is indentation 44 to secure the arch 38 of the staple 45 which is located between the two brads 47. When the driver shaft 23 is struck, preferably with a hammer, the driver shaft 23 is depressed, forcing the driver plate 31 and the strikers 35 downwardly to impact the brads 47 simultaneously, thereby nailing the staple 45 in place. The block 37 prevents the strikers 35 from traveling too far and damaging either the staple 45 or the wiring held by the staple 45. As the pressure of the hammer stroke is lifted, the driver spring 33 and the striker springs 43 return the driver shaft 23 and strikers 35 to their original position within the Stapling Device.

Figure 2:
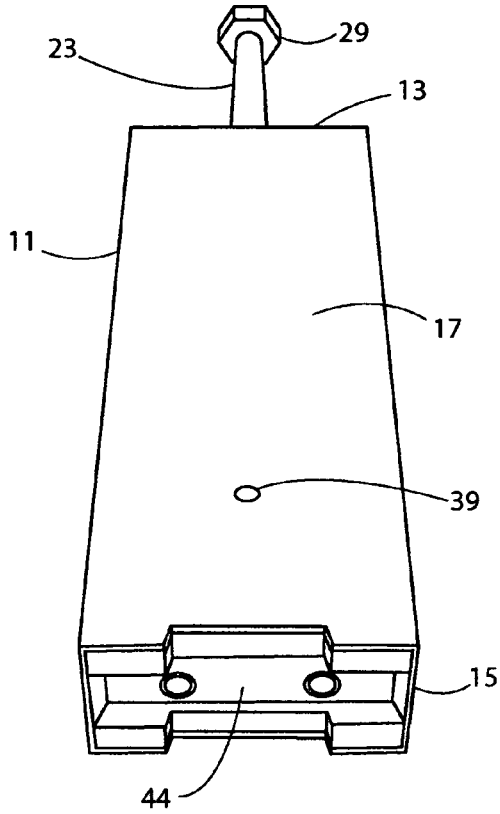
FIG. 2 is a pictorial view of the stapling device showing the base of the Stapling device without a staple being placed in the stapling device.
Figure 3:
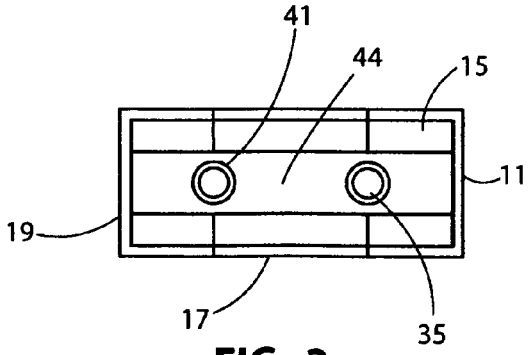
FIG. 3 is a plan view of the bottom of the Stapling Device.
Figure 4:
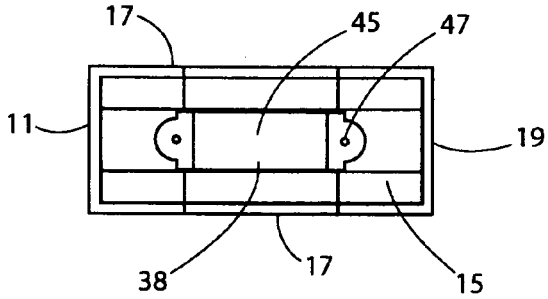
FIG. 4 is a plan view similar to FIG. 3 but with a staple in place.

Referring now to FIGS. 2 and 3, a bottom view of the Stapling Device is shown, showing an indentation 44 of the bottom surface of the block 37 into which the arch 38 of a staple 45 fits. Also shown are the ends of the channels 41 through which the strikers 35 travel. The brads 47 of the staple 45 are positioned within the channels 41 so that when the Stapling Device is struck with a hammer, the brads 47 are aligned to receive the impact at an angle that will cause them to be secured as desired, but will not harm the arch 38 of the staple 45 or the cable or wires held by the staple 45.

Referring now to FIG. 1, the channels 41 in the plastic block 37 are generally perpendicular to the driver plate 31. Accordingly, the channels 41, and therefore the strikers 35, are generally parallel to one another. The strikers 35 impact the brads 47 of a staple 45 squarely and drive both brads 47 into the base material beneath.

This Stapling Device is designed as a hand-held tool. However, many different sizes are possible for the device in others embodiments, depending upon the staple 45 size for which the Stapling Device may be used.

While a preferred embodiment is shown and described herein, it should be understood that the present disclosure is made by way of example only and that variations in the described Stapling Device and its uses are possible within the scope of this disclosure without departing from the subject matter coming within the scope of the following claims, and a reasonable equivalency thereof, which claims I regard as my invention.

The invention claimed is:

1. A Stapling Device for nailing staples comprising:

a body having an upper end and a lower end, the body being hollow toward the upper end, a block with two channels being secured within the body at the lower end;

a cap plate having an opening through it, mounted on the upper end of the body;

a driver shaft mounted to slide in the opening in the cap plate;

a driver plate mounted to slide in the body above the block, the driver shaft being secured to the driver plate;

two strikers connected to the driver plate and extending away from the driver shaft, the strikers being mounted to slide in the channels in the block;

a driver spring located about the driver rod between the driver plate and the cap plate and;

striker springs located about the two strikers between the driver plate and block.

2. The Stapling Device for nailing staples according to claim 1 wherein the strikers are generally perpendicular with the driver plate.

3. The Stapling Device for nailing staples according to claim 1 wherein the block limits the movement of the driver plate toward the lower end of the body.

4. The Stapling Device according to claim 1 wherein the cross-section and the horizontal cross-section of the body are rectangular.

5. A Stapling Device for nailing staples comprising:

a body having an upper end and a lower end, the body having a rectangular cross-section both vertically and horizontally;

a block having two openings secured to the body at the lower end of the body, the block further having two channels through it and having an indentation at the lower end, the channels through it and having an indentation at the lower end, the channels being at opposite ends of the indentation;

a cap plate having an opening through it;

a driver shaft mounted to slide in the opening in the cap plate;

a driver plate mounted to slide in the body toward the upper end from the block, the driver plate being rectangular;

two strikers connected to the driver plate and extending away from the driver shaft, the two strikers being mounted to slide in the channels in the block;

a driver spring located about the driver shaft between the cap plate and the driver plate; and a pair of striker springs located about two strikers between the driver plate and the block.

6. The Stapling Device according to claim 5 wherein the cap plate has a center point and the opening in the cap plate is located substantially at the center point.

7. The Stapling Device according to claim 5 wherein the strikers are perpendicular with the driver plate.

8. A Stapling Device for nailing staples comprising:

a body having an upper end and a lower end, the body having a rectangular cross-section both vertically and horizontally;

a block having two openings secured to the body at the lowest end of the body, the block further having two channels being at the opposite end of the indentation and being unclaimed toward one another at the lower end of the body;

a cap plate having an opening through it;

a driver shaft mounted to slide in the opening in the cap plate;

a driver plate mounted to slide in the body toward the upper end from the block, the driver plate being rectangular and being connected to the driver shaft;

two strikers connected to the driver plate and extending away from the driver shaft, the strikers being mounted to slide in the channels in the block;

a driver spring located about the driver rod between the cap plate and the driver plate; and striker springs located about the two strikers between the drive plate and the block.

9. The Stapling Device according to claim 8 wherein the cap plate has a center point and the opening in the cap plate is located substancially at the center point.

10. The Stapling Device according to claim 8 wherein the strikers are connected to the driver plate generally at right angles.

* * * * *